US009444150B2

(12) United States Patent
Hirobe et al.

(10) Patent No.: US 9,444,150 B2
(45) Date of Patent: Sep. 13, 2016

(54) ANTENNA DEVICE AND PORTABLE WIRELESS TERMINAL EQUIPPED WITH SAME

(75) Inventors: Takanori Hirobe, Ishikawa (JP); Hiroyuki Uejima, Ishikawa (JP); Yoshio Koyanagi, Kanagawa (JP); Hiroshi Satou, Kanagawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 171 days.

(21) Appl. No.: 14/001,664

(22) PCT Filed: Apr. 17, 2012

(86) PCT No.: PCT/JP2012/002654

§ 371 (c)(1),
(2), (4) Date: Aug. 26, 2013

(87) PCT Pub. No.: WO2012/144198

PCT Pub. Date: Oct. 26, 2012

(65) Prior Publication Data

US 2013/0328742 A1 Dec. 12, 2013

(30) Foreign Application Priority Data

Apr. 20, 2011 (JP) ..... 2011-093744

(51) Int. Cl.

| | |
|---|---|
| ***H01Q 21/28*** | (2006.01) |
| ***H01Q 1/24*** | (2006.01) |
| ***H01Q 1/52*** | (2006.01) |
| ***H01Q 5/335*** | (2015.01) |
| ***H01Q 5/35*** | (2015.01) |

(52) U.S. Cl.

CPC ..... *H01Q 21/28* (2013.01); *H01Q 1/243* (2013.01); *H01Q 1/521* (2013.01); *H01Q 5/335* (2015.01); *H01Q 5/35* (2015.01)

(58) Field of Classification Search

CPC ..... H01Q 21/28
USPC ..... 343/853
See application file for complete search history.

(56) References Cited

U.S. PATENT DOCUMENTS

| | | | | |
|---|---|---|---|---|
| 7,688,275 | B2 | 3/2010 | Montgomery et al. | |
| 2008/0258991 | A1* | 10/2008 | Montgomery et al. | 343/844 |
| 2010/0265146 | A1 | 10/2010 | Montgomery et al. | |

FOREIGN PATENT DOCUMENTS

| | | | |
|---|---|---|---|
| JP | 2004-096303 | A | 3/2004 |
| JP | 2009-521898 | A | 6/2009 |

OTHER PUBLICATIONS

International Search Report, mailed Jul. 10, 2012, for PCT/JP2012/002654, 2 pages.

* cited by examiner

*Primary Examiner* — Dameon E Levi
*Assistant Examiner* — Andrea Lindgren Baltzell
(74) *Attorney, Agent, or Firm* — Seed IP Law Group PLLC

(57) ABSTRACT

A first connection circuit (108) is adjusted to cancel out mutual coupling impedance occurring between a first antenna element (106) in a first frequency band and a second antenna element (107) in a second frequency band, and reduces a degradation occurring due to the coupling between the antenna elements. A second frequency band cutoff circuit (111) for the second frequency band is provided between the first antenna element (106) and the first feeding portion (104).

9 Claims, 16 Drawing Sheets

FIG. 3

| | 1.5-GHz BAND CONNECTION CIRCUIT 108a | 800-MHz BAND CUTOFF CIRCUIT 111a | 2.4-GHz BAND CUTOFF CIRCUIT 111b |
|---|---|---|---|
| CONDITION 1 | ABSENT | ABSENT | ABSENT |
| CONDITION 2 | PRESENT | ABSENT | ABSENT |
| CONDITION 3 | PRESENT | PRESENT | ABSENT |
| CONDITION 4 | PRESENT | ABSENT | PRESENT |

(a) CONDITION 2

(b) CONDITION 3

(a) CONDITION 4

FIG. 11

| | 1.5-GHz BAND CONNECTION CIRCUIT 108b | 800-MHz BAND CUTOFF CIRCUIT 111a | 2.4-GHz BAND CUTOFF CIRCUIT 112a |
|---|---|---|---|
| CONDITION 1 | ABSENT | ABSENT | ABSENT |
| CONDITION 2 | PRESENT | ABSENT | ABSENT |
| CONDITION 3 | PRESENT | PRESENT | PRESENT |

(a) CONDITION 2

(b) CONDITION 3

(a)

(b)

ANTENNA DEVICE AND PORTABLE WIRELESS TERMINAL EQUIPPED WITH SAME

TECHNICAL FIELD

The present invention is directed to a technique relating to an antenna for a portable wireless terminal and is to realize a high degree of isolation between two elements in a wide band.

BACKGROUND ART

Portable wireless terminals such as cell phones are being enhanced increasingly in multifunctionality; for example, they have come to be provided with not only the telephone function, the e-mail function, and the function of accessing the Internal etc. but also the short-range wireless communication function, the wireless LAN function, the GPS function, the TV viewing function, the IC card settlement function, etc. With such enhancement in multifunctionality, the number of antennas incorporated in portable wireless terminals is increasing and degradation of the antenna performance due to coupling between plural antenna elements is now a serious problem.

On the other hand, from the viewpoints of design performance and portability, portable wireless terminals are now desired to be further miniaturized and increased in integration density. To maintain good antenna characteristics while miniaturizing a terminal, it is necessary to make various improvements in the arrangement of antenna elements and the coupling between the antenna elements. Furthermore, a high-performance antenna system is desired in which the numbers of feeding paths and antenna elements are made as small as possible and a proper measure against degradation due to coupling is taken.

As disclosed in, for example, Patent Literature 1 and Non-patent Literature 1, portable wireless terminals are known which solve the problem of coupling between an elements. These portable wireless terminals are configured so as to realize low correlation between antennas by inserting a connection circuit so that it connects feeding portions of array antenna elements and thereby canceling out mutual coupling impedance between the antennas.

CITATION LIST

Patent Literature

Patent Literature 1: US 2008/0258991A1 (e.g., FIG. 6A)

Non-Patent Literature

Non-patent Literature 1: "Decoupling and descattering networks for antennas," IEEE Transactions on Antennas and Propagation, Vol. 24, Issue 6, November 1976.

SUMMARY OF INVENTION

Technical Problem

However, the general configurations disclosed in Patent Literature 1 and Non-patent Literature 1 assume operation in the same frequency band and they do not refer to a case of operation in different frequency bands. Therefore, a problem remains that where plural antenna elements that operate in not only the same frequency band but also different frequency bands are disposed close to each other, degradation due to coupling occurs between the different frequency bands.

To solve the above problems of portable wireless terminals equipped with two or more antenna elements operating in plural frequency bands (a case that they operate in the same frequency band is included), an object of the present invention is to provide an antenna device which can secure a high degree of isolation by lowering the degree of coupling in the case of operation in the same frequency band and can realize high-gain performance by increasing the antenna operation volume by using a cutoff circuit(s) in the case of operation in different frequency bands, as well as a portable wireless terminal equipped with the same.

Solution to Problem

An antenna device according to an aspect of the present invention is configured by including: an enclosure; a circuit board provided in the enclosure and having a ground pattern; a first antenna element which is made of a conductive metal and operates in a first frequency band; a second antenna element which is made of a conductive metal and operates in the first frequency band and a second frequency band; a first connection circuit which electrically connects portions of the first antenna element and the second antenna element; a first radio circuit unit provided on the circuit board; a first feeding portion electrically connected to the first radio circuit unit; a second radio circuit unit provided on the circuit board; a second feeding portion electrically connected to the second radio circuit unit; and a second frequency band cutoff circuit for electrical cutoff in the second frequency band, wherein the first antenna element and the second antenna element are disposed close to each other so as have a predetermined interval from the ground pattern on the circuit board, the first antenna element is electrically connected to the first feeding portion via the second frequency band cutoff circuit, the second antenna element is electrically connected to the second feeding portion, and the first connection circuit is configured to cancel out mutual coupling impedance between the first antenna element and the second antenna element in the first frequency band.

With this configuration, in the first frequency band, high-efficiency antennas can be obtained by reducing opposite-phase currents occurring between the first antenna element and the second antenna element by means of the low coupling circuit. In the second frequency band, high-efficiency antennas can be obtained because the power consumed in the first feeding portion is suppressed by the second frequency hand cutoff circuit and the antenna operation volume is increased.

In the antenna device according to the aspect of the present invention, the first antenna element is electrically connected to the first feeding portion via a first impedance matching circuit, or the second antenna element is electrically connected to the second feeding portion via a second impedance matching circuit.

This configuration makes it possible to realize antenna characteristics with even lower coupling in a desired frequency band.

In the antenna device according to the aspect of the present invention, one or both of the first antenna element and the second antenna element are partly at least formed of a copper foil pattern formed on the printed circuit board.

This configuration makes it possible to arrange antenna elements with high accuracy and thereby realize antennas that are high in mass productivity.

In the antenna device according to the aspect of the present invention, the first antenna element operates in the first frequency band and a third frequency band which is higher than the first frequency band, the second antenna element operates in the first frequency band and the second frequency band which is lower than the first frequency band, and a third frequency band cutoff circuit for electrical cutoff in the third frequency band is electrically connected between the second antenna element and the second feeding portion.

With this configuration, in the first frequency band, high-efficiency antennas can be obtained by reducing opposite-phase currents occurring between the first antenna element and the second antenna element by means of the low coupling circuit. In the second frequency band, high-efficiency antennas can be obtained because the power consumed in the first feeding portion is suppressed by the second frequency band cutoff circuit and the antenna operation volume is increased. In the third frequency band, high-efficiency antennas can be obtained because the power consumed in the second feeding portion is suppressed by the third frequency band cutoff circuit and the antenna operation volume is increased.

Further, the antenna device according to the aspect of the present invention is incorporated in a portable wireless terminal.

This configuration makes it possible to improve the antenna characteristics of the portable wireless terminal and thereby miniaturize it.

Advantageous Effects of Invention

The antenna device and the portable wireless terminal according to the present invention can realize an antenna device which can secure a high degree of isolation by lowering the degree of coupling in the case of operation in the same frequency band and can realize high-gain performance by increasing the antenna operation volume by using a cutoff circuit(s) in the case of operation in different frequency bands, as well as a portable wireless terminal incorporating it.

BRIEF DESCRIPTION OF DRAWINGS

FIG. 3 is a table showing analysis conditions 1 to 4 which are used in the first embodiment of the present invention.

FIG. 11 is a table showing analysis conditions 1 to 3 which are used in the third embodiment of the present invention.

MODE FOR CARRYING OUT INVENTION

Embodiments of the present invention will be hereinafter described with reference to the drawings.

(Embodiment 1)

Figure 1:
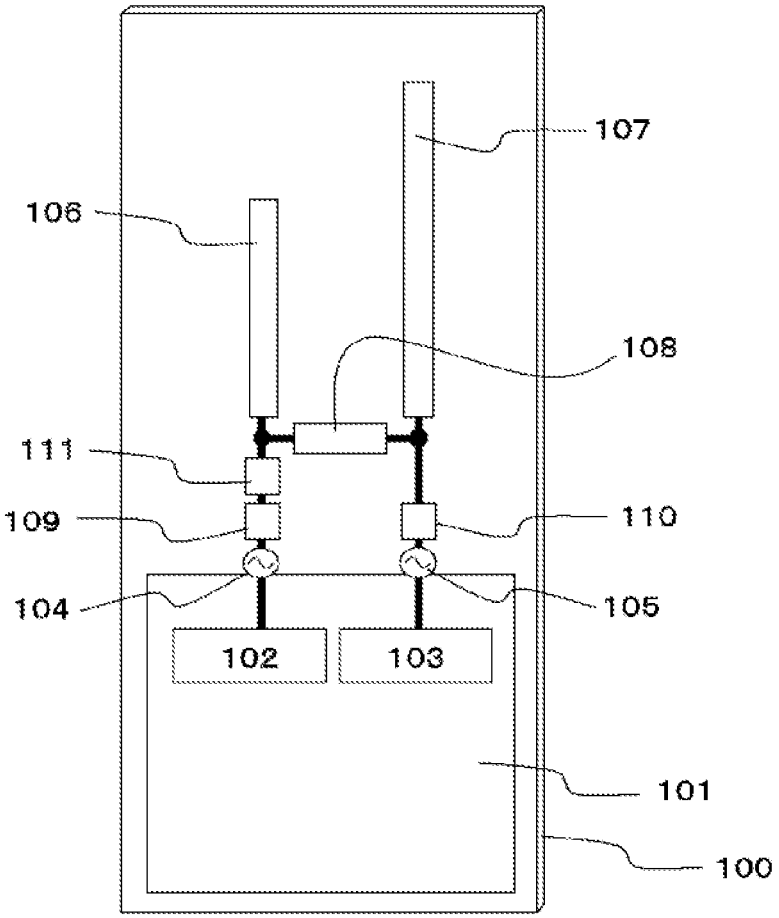
FIG. 1 shows a configuration of a portable wireless terminal according to a first embodiment of the present invention.

FIG. 1 shows a configuration of a portable wireless terminal according to a first embodiment of the present invention. As shown in FIG. 1, a first radio circuit unit 102 is formed on a circuit board 101 which is disposed inside the portable wireless terminal 100. A first antenna element 106 which is made of a conductive metal is supplied with a high-frequency signal via a first feeding portion 104. The first antenna element 106 is given such an electrical length as to operate in a first frequency band, for example, a length that is equal to ¼ of the wavelength of the center frequency of the first frequency band. A second radio circuit unit 103 is also formed on the circuit board 101, and a second antenna element 107 which is made of a conductive metal is supplied with a high-frequency signal via a second feeding portion 105. The second antenna element 107 is given such an electrical length as to operate in both of a first frequency band and a second frequency band, for example, a length that is equal to ¼ of the wavelength of the center frequency between the first frequency band and the second frequency band.

Each of the first antenna element 106 and the second antenna element 107 can exhibit desired performance in the corresponding frequency band(s) in a state that it is disposed singly. However, if the first antenna element 106 and the second antenna element 107 are disposed in a central portion of the portable wireless terminal 100 in its width direction approximately parallel with each other with a distance that is shorter than 0.02 times the wavelength of the center frequency of the first frequency band, mutual coupling impedance occurs between the antenna elements to cause a phenomenon that a high-frequency current flowing through one antenna element causes an induction current in the other antenna element. As a result, the radiation performance of each antenna degrades in the first frequency band in which the two antenna elements operate.

In view of the above, the first antenna element 106 and the second antenna element 107 are connected to each other by a first connection circuit 108, whereby the mutual coupling impedance occurring between the antennas in the first frequency band is canceled out and the degradation occurring due to the coupling between the antenna elements in the first frequency band is thereby reduced.

However, there still remains a problem that a high-frequency current in the second frequency band that is supplied from the second feeding portion flows into the first feeding portion via the first connection circuit 108 and is consumed by the resistance component of the first radio circuit. In view of this, in the present invention, a second frequency band cutoff circuit 111 for the second frequency band is connected between the first antenna element 106 and the first feeding portion 104. With this measure, a high-frequency current in the second frequency band that is supplied from the second feeding portion does not flow into the first feeding portion via the first connection circuit 108, whereby the degradation due to coupling can be reduced.

In this configuration, since the second frequency band cutoff circuit 111 is provided, not only does a high-frequency current in the second frequency band that is supplied from the second feeding portion flow into the second antenna element 107 but also it flows into the first antenna element 106 effectively. As a result, the antenna operation volume can be increased and the radiation efficiency in the second frequency band can be increased.

Furthermore, for the first antenna element 106, a first impedance matching circuit 109 is provided between the second frequency band cutoff circuit 111 and the first feeding portion 104. And the second antenna element 107 is connected to the second feeding portion 105 via a second impedance matching circuit 110. The provision of the first impedance matching circuit 109 and the second impedance matching circuit 110 makes it possible to more finely perform impedance matching with the first antenna element 106, impedance matching with the second antenna element 107, and adjustments for canceling out the mutual coupling impedance between the antenna elements, and thereby enhances the effect of reducing the degradation due to coupling.

In the configuration of FIG. 1, the first antenna element 106 and the second antenna element 107 are described as being conductive metal parts. However, the same advantages can be obtained even if all or part of each of the first antenna element 106 and the second antenna element 107 is formed of a copper foil pattern formed on a printed circuit board.

Figure 2:
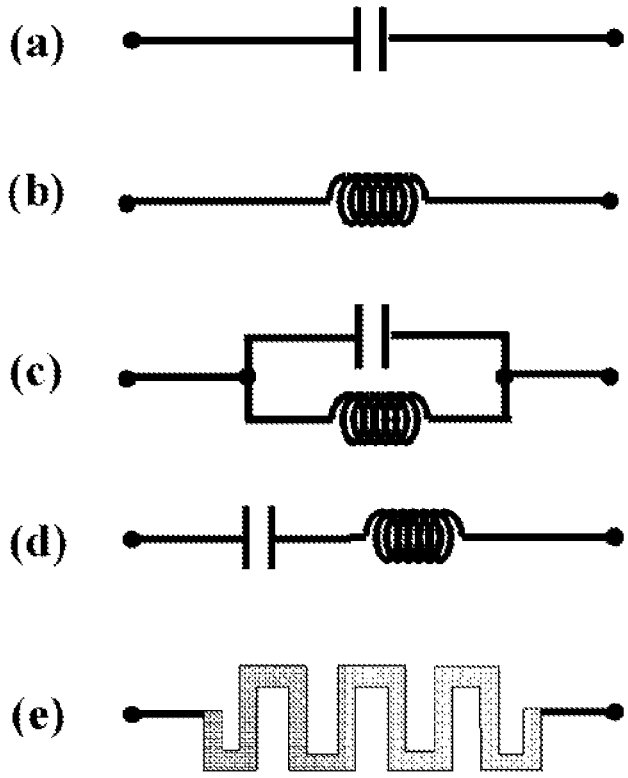
In FIG. 2, (*a*) to (*e*) show specific structures of a connection circuit which is used in the first embodiment of the present invention.

In FIG. 2, (*a*) to (*e*) show specific structures of the first connection circuit which is used in the first embodiment of the present invention. As shown in FIG. 2, the first connection circuit 108 can be configured in the form of any of (a) a capacitor, (b) an inductor, (c) a parallel resonance circuit, (d) a series resonance circuit, and (e) a meandering pattern. The first connection circuit 108 may be configured in any other form (e.g., a filter or a capacitor consisting of patterns) as long as its equivalent circuit can be expressed as a combination of capacitors and inductors and enables adjustment of mutual coupling impedance. Furthermore, the first connection circuit 108 may be configured as a combination of plural such structures.

In the configuration of FIG. 1, although mutual coupling occurs between the two antenna elements, the mutual coupling impedance between them can be adjusted comprehensively by providing the impedance matching circuits. As a result, pass characteristics S12 and S21 between the first feeding portion 104 and the second feeding portion 105 can be made small in each of the first frequency band and the second frequency band and the degradation due to coupling can thereby be reduced.

Next, a description will be made of example results of analyses on the performance of specific configuration of FIG. 1. In the following description, it is assumed that the first and second frequency bands are assumed to be a 1.5-GHz band and an 800-MHz band, respectively, and a third frequency band is assumed to be a 2.4-GHz band.

FIG. 3 is a table showing characteristic analysis conditions for the portable wireless terminal according to the first embodiment of the present invention. A 1.5-GHz band connection circuit 108*a* accommodates the 1.5-GHz band, and an 800-MHz band cutoff circuit 111*a* and a 2.4-GHz band cutoff circuit 111*b* are provided. Conditions 1 to 4 are different from each other in the presence/absence of the 1.5-GHz hand connection circuit 108*a*, the 800-MHz band cutoff circuit 111*a*, and the 2.4-GHz band cutoff circuit 111*b*.

Figure 4:
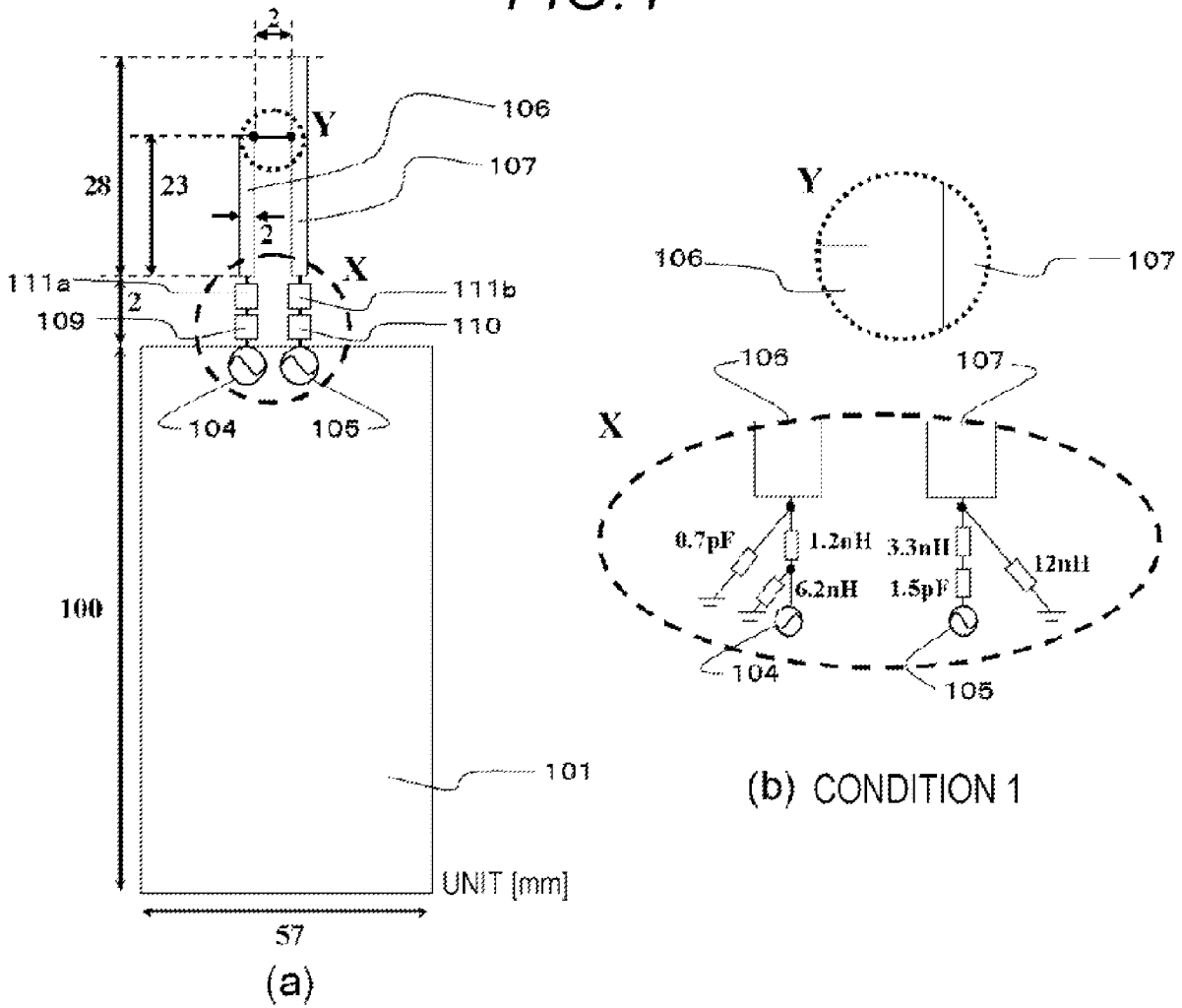
In FIG. 4, (*a*) and (*b*) show a characteristic analysis model of condition 1 for the portable wireless terminal according to the first embodiment of the present invention.

FIGS. 4(*a*) to 6(*a*) show characteristic analysis models for the portable wireless terminal according to the first embodiment of the present invention. As shown in FIG. 4(*a*), an analysis is performed using a model of the circuit board 101 which is a printed circuit board made of a glass epoxy resin, the model being a copper foil of 130 mm in length and 57 mm in width. The circuit board 101 supplies high-frequency signals to the first antenna element 106 and the second antenna element 107 which are conductive copper plates via the first feeding portion 104 and the second feeding portion 105, respectively.

The first feeding portion 104 supplies a high-frequency signal in a range of 0.6 GHz to 3 GHz which includes the 1.5-GHz band and the 2.4-GHz band which corresponds to the 2.4-GHz band cutoff circuit 111*b*. The second feeding portion 105 supplies a high-frequency signal in a range of 0.6 GHz to 3 GHz which includes the 1.5-GHz band and the 800-MHz band which corresponds to the 800-MHz band cutoff circuit 111*a*. A pass characteristic S21 and reflection characteristics S11 and S22 which are S parameters and radiation efficiency are analyzed at the above analysis frequencies.

The first antenna element 106 is a conductor plate of 23 mm in length and 2 mm in width. On the other hand, the second antenna element 107 is a conductor plate of 28 mm in length and 2 mm in width.

The first antenna element 106 and the second antenna element 107 are disposed adjacent to end portions of the circuit board 101. Approximately-parallel-extending portions (closest portions) of the first antenna element 106 and the second antenna element 107 are very close to each other at an interval, i.e., the interval is 2 mm which is 0.01 times the wavelength at 1.5 GHz. Since the first antenna element 106 and the second antenna element 107 are disposed approximately parallel with each other with a very short electrical distance, mutual coupling occurs between the antenna elements and a high-frequency current flowing through one antenna element causes an induction current in the other antenna element. This results in degradation in antenna radiation performance in the first frequency band in which both antenna elements operate. In view of this, the 1.5-GHz band connection circuit 108*a* is inserted so as to be connected between end portions of the first antenna element 106 and the second antenna element 107, whereby mutual coupling impedance occurring between the antennas in the 1.5-GHz band is canceled out and the degradation occurring due to the coupling between the antennas in the 1.5-GHz band is thereby reduced.

Since the 800-MHz hand cutoff circuit 111*a* is provided between the first antenna element 106 and the first feeding portion 104, the flowing of a high-frequency current in the 800-MHz band into the first feeding portion 104 via the 1.5-GHz band connection circuit 108*a* is suppressed and the degradation due to the coupling between the first feeding portion 104 and the second feeding portion 105 can thereby be reduced. Since not only does a high-frequency current in the 800-MHz band flow through the second antenna element 107 but also a high-frequency current in the 800-MHz band is effectively caused to flow through the first antenna element 106, the antenna operation volume can be increased and the radiation efficiency in the 800-MHz band can thereby be increased. On the other hand, since the 2.4-GHz baud cutoff circuit 111*b* is provided between the second antenna element 107 and the second feeding portion 105, the flowing of a high-frequency current in the 2.4-GHz band into the second feeding portion 105 via the 1.5-GHz band connection circuit 108*a* is suppressed and the degradation occurring due to the coupling between the first feeding portion 104 and the second feeding portion 105 can thereby be reduced. Since not only does a high-frequency current in the 2.4-GHz band flow through the first antenna element 106 but also a high-frequency current in the 2.4-GHz band is effectively caused to flow through the second antenna element 107, the antenna operation volume can he increased and the radiation efficiency in the 2.4-GHz band can thereby be increased.

Furthermore, since the first impedance matching circuit 109 is provided between the first feeding portion 104 and the 800-MHz band cutoff circuit 111*a* and the second impedance matching circuit 110 is provided between the second feeding portion 105 and the 2.4-GHz band cutoff circuit 111*b*, impedance matching with the first antenna element 106, impedance matching with the second antenna element 107, and adjustments for canceling out the mutual coupling impedance between the antenna elements can be made more finely and the effect of reducing the degradation due to coupling is thereby enhanced.

FIG. 4(*b*) shows circuit structures corresponding to condition 1 shown in FIG. 3 which are provided in respective regions X and Y shown in FIG. 4(*a*). According to condition 1 shown in FIG. 3, the 1.5-GHz hand connection circuit 108*a* is not provided in the region Y Shown in FIG. 4(*b*). On the other hand, in the region X, the first impedance matching circuit 109 is provided in which 1.2 nH is provided in series with the first antenna element 106 from the side of the first feeding portion 104. Furthermore, 6.2 nH is provided between the ground pattern of the circuit board and the connecting point of the first feeding portion 104 and 1.2 nH and 0.7 pF is provided between the ground pattern of the circuit board and the connecting point of the first antenna element 106 and 1.2 nH (6.2 nH and 0.7 pF are each grounded).

In the second impedance matching circuit 110, 1.5 pF and 3.3 nH are provided in series with the second antenna element 107 in this order from the side of the second feeding portion 105. Furthermore, 12 nH is provided between the ground pattern of the circuit board and the connecting point of the second antenna element 107 and 3.3 nH (12 nH is grounded). The circuit configuration corresponding to condition 1 has been described above.

Figure 5:
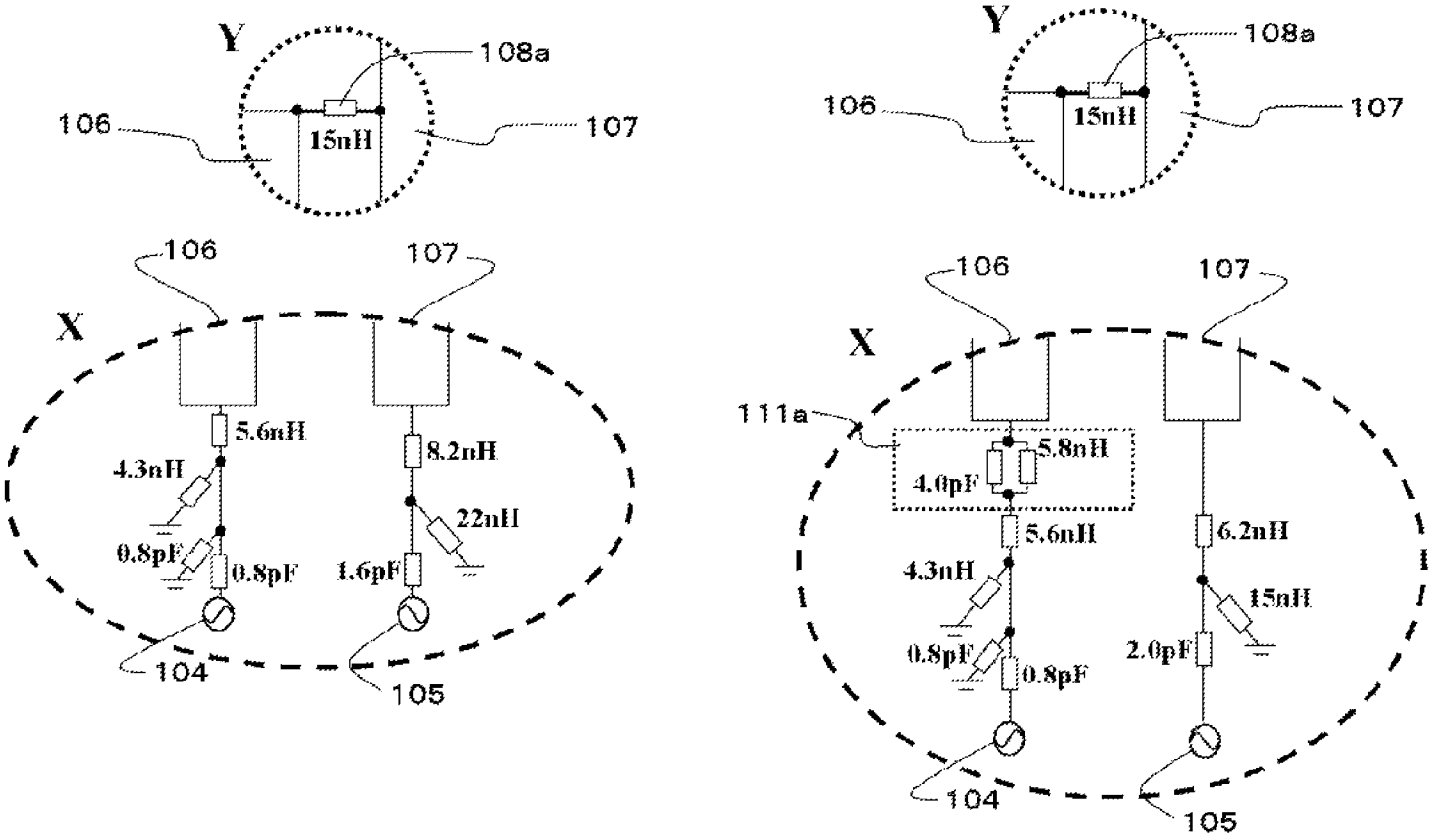
In FIG. 5, (*a*) and (*b*) show characteristic analysis models of conditions 2 and 3 for the portable wireless terminal according to the first embodiment of the present invention.

FIG. 5(*a*) shows circuit structures corresponding to condition 2 shown in FIG. 3 which are provided in the respective regions X and Y shown in FIG. 4(*a*). According to condition 2 shown in FIG. 3, an inductor of 15 nH is provided as the 1.5-GHz band connection circuit 108*a* in the region Y shown in FIG. 5(*a*). On the other hand, in the region X, the first impedance matching circuit 109 is provided in which 0.8 pF and 5.6 nH are provided in series with the first antenna element 106 in this order from the side of the first feeding portion 104. Furthermore, 0.8 pF and 4.3 nH are provided between the ground pattern of the circuit board and the connecting point of 0.8 pF and 5.6 nH (0.8 pF and 4.3 nH are each grounded).

In the second impedance matching circuit 110, 1.6 pF and 8.2 nH are provided in series with the second antenna element 107 in this order from the side of the second feeding portion 105. Furthermore, 22 nH is provided between the ground pattern of the circuit board and the connecting point of 1.6 pF and 8.2 nH (22 nH is grounded). The circuit configuration corresponding to condition 2 has been described above.

FIG. 5(*b*) shows circuit structures corresponding to condition 3 shown in FIG. 3 which are provided in the respective regions X and Y shown in FIG. 4(*a*). According to condition 3 shown in FIG. 3, an inductor of 15 nH is provided as the 1.5-GHz band connection circuit 108*a* in the region Y shown in FIG. 5(*b*). On the other hand, in the region X, the first impedance matching circuit 109 is provided in which 0.8 pF and 5.6 nH are provided in series with the first antenna element 106 in this order from the side of the first feeding portion 104. Furthermore, a parallel resonance circuit which is composed of 4.0 pF and 5.8 nH and corresponds to the 800-MHz hand cutoff circuit 111*a* is provided between 5.6 nH and the first antenna element 106.

Still further, 0.8 pF and 4.3 nH are provided between the ground pattern of the circuit board and the connecting point of 0.8 pF and 5.6 nH (0.8 pF and 4.3 nH are each grounded). In the second impedance matching circuit 110, 2.0 pF and 6.2 nH are provided in series with the second antenna element 107 in this order from the side of the second feeding portion 105. Furthermore, 15 nH is provided between the ground pattern of the circuit board and the connecting point of 2.0 pF and 6.2 nH (15 nH is grounded). The circuit configuration corresponding to condition 3 has been described above.

Figure 6:
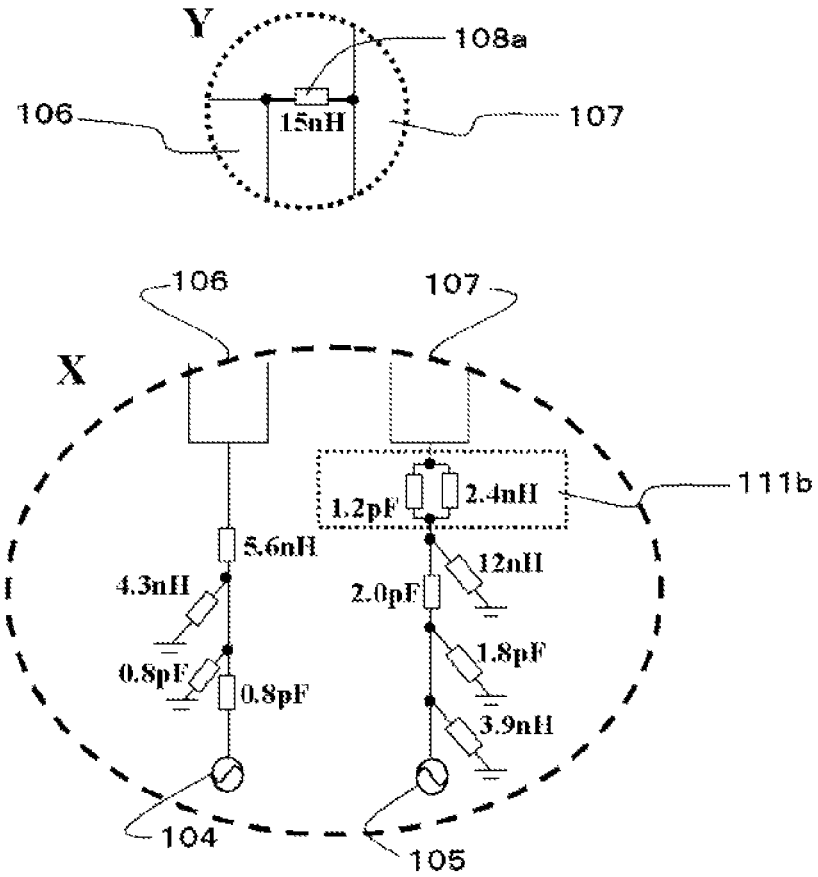
In FIG. 6, (*a*) shows a characteristic analysis model of condition 4 for the portable wireless terminal according to the first embodiment of the present invention.

FIG. 6(*a*) shows circuit structures corresponding to condition 4 shown in FIG. 3 which are provided in the respective regions X and Y shown in FIG. 4(*a*). According to condition 4 shown in FIG. 3, an inductor of 15 nH is provided as the 1.5-GHz band connection circuit, 108*a* in the region Y shown in FIG. 6(*a*). On the other hand, in the region X, the first impedance matching circuit 109 is provided in which 0.8 pF and 5.6 nH are provided in series with the first antenna element 106 in this order from the side of the first feeding portion 104. Furthermore, 0.8 pF and 4.3 nH are provided between the ground pattern of the circuit board and the connecting point of 0.8 pF and 5.6 nH (0.8 pF and 4.3 nH are each grounded).

In the second impedance matching circuit 110, 2.0 pF is provided in series with the second antenna element 107 from the side of the second feeding portion 105. Furthermore, a parallel resonance circuit which is composed of 1.2 pF and 2.4 nH and corresponds to the 2.4-GHz band cutoff circuit 111*b* is provided between 2.0 pF and the second antenna element 107. Furthermore, 3.9 nH and 1.8 pF are provided between the ground pattern of the circuit board and the connecting point of the second feeding portion 105 and 2.0 pF (3.9 nH and 1.8 pF are each grounded), and 12 nH is provided between the ground pattern of the circuit board and the connecting point of 2.0 pF and the 2.4-GHz band cutoff circuit 111*b* (12 nH is grounded). The circuit configuration corresponding to condition 4 has been described above.

Figure 7:
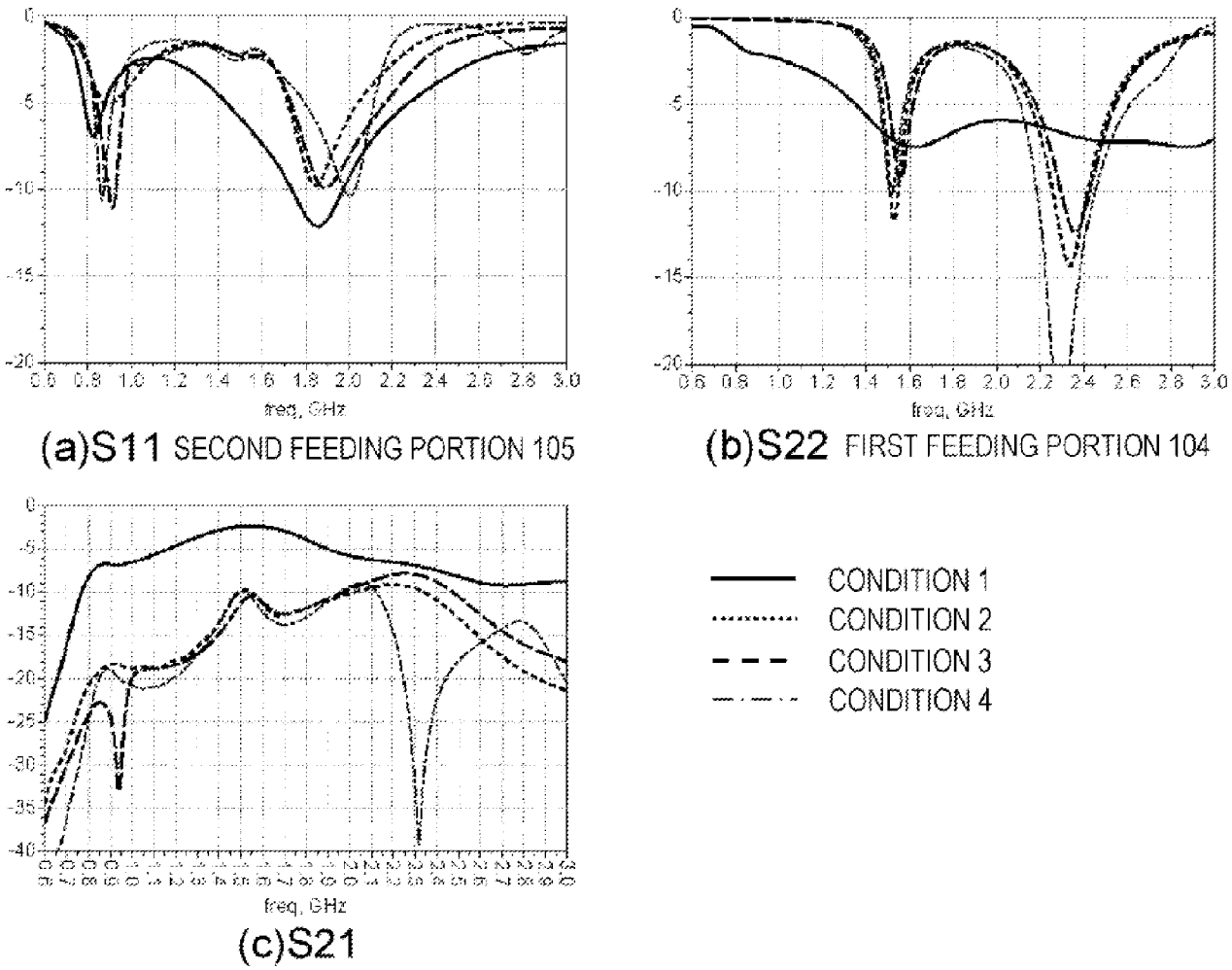
In FIG. 7, (*a*) to (*e*) are characteristic graphs showing frequency characteristics of the portable wireless terminal according to the first embodiment of the present invention which were obtained under analysis conditions 1 to 4.
Figure 8:
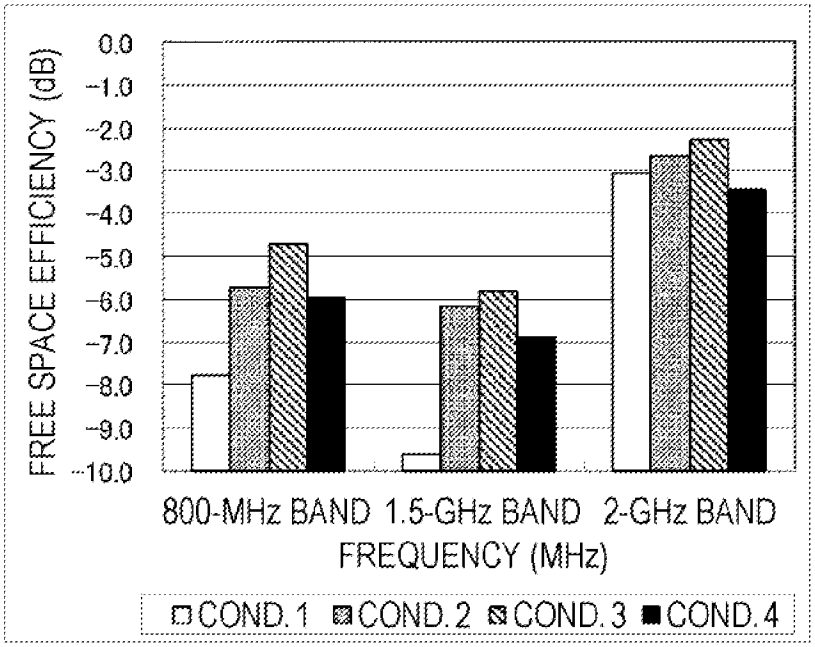
In FIG. 8, (*a*) and (*b*) are characteristic graphs showing free space efficiency of the portable wireless terminal according to the first embodiment of the present invention which were obtained under the analysis conditions 1 to 4.
Figure 8:
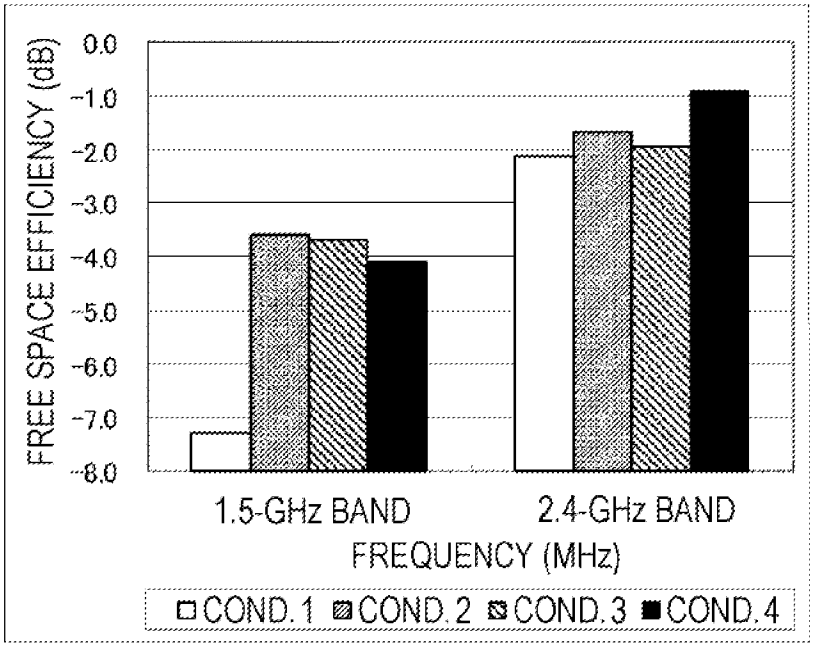

FIGS. 7(*a*) to 8(*b*) are characteristic graphs of the first embodiment of the present invention which were obtained by analyses using the analysis models shown in FIGS. 4(*a*)-6(*a*). FIG. 7(*a*) shows S11 curves as viewed from the second feeding portion 105, FIG. 7(*b*) shows S22 curves as viewed from the first feeding portion 104, and FIG. 7(*c*) shows S21 curves which are pass characteristics from the second feeding portion 105 to the first feeding portion 104. In each of FIGS. 7(*a*) to 7(*c*), the horizontal axis represents the frequency from 0.6 GHz to 3 GHz. FIG. 8(*a*) shows free space efficiency characteristics of the second antenna element 107, and FIG. 8(*b*) shows free space efficiency characteristics of the first antenna element 106.

As seen from FIG. 7(*a*), under conditions 1 to 4, S11 is small (approximately smaller than −5 dB) in the 800-GHz band and a range of 1.7 GHz to 2.1 GHz, which means that impedance matching is made properly in these frequency ranges.

On the other hand, as seen from FIG. 7(*b*), under conditions 1 to 4, S22 is small (approximately smaller than −5 dB) in the 1.5-GHz band and the 2.4-GHz band, which means that impedance matching is made properly in these frequency ranges. As shown in FIG. 7(*c*), under all the conditions except condition 1, the pass characteristic S21 is small (smaller than −10 dB) over the almost entire frequency range, which means a high degree of isolation is secured and the degradation due to coupling is reduced.

As seen from FIG. 8(*a*), as for the free space efficiency of the second antenna element 107, the antenna efficiency is higher under conditions 2-4 than under condition 1. It is seen that in the 1.5-GHz band the degradation due to coupling is reduced to a large extent because S21 is about −10 dB. It is also seen that under condition 3 (the 800-MHz hand cutoff circuit 111*a* is provided) the free space efficiency is increased in the 800-MHz band.

Likewise, as seen from FIG. 8(*b*), as for the free space efficiency of the first antenna element 106, the antenna efficiency is higher under conditions 2-4 than under condition 1. It is seen that in the 1.5-GHz band the degradation due to coupling is reduced to a large extent because S21 is about −10 dB. It is also seen that under condition 4 (the 2.4-GHz band cutoff circuit 111*b* is provided) the free space efficiency is increased in the 2.4-GHz band.

As described above, with the first antenna element 106 which operates in the first frequency band and the second antenna element 107 which operates in the first frequency band and the second frequency band, the first embodiment makes it possible to form built-in antennas in which in the first frequency band a high degree of isolation is secured by lowering the degree of coupling and in the second frequency band high-gain performance can be realized by increasing the antenna operation volume by using the cutoff circuit.

(Embodiment 2)

Figure 9:
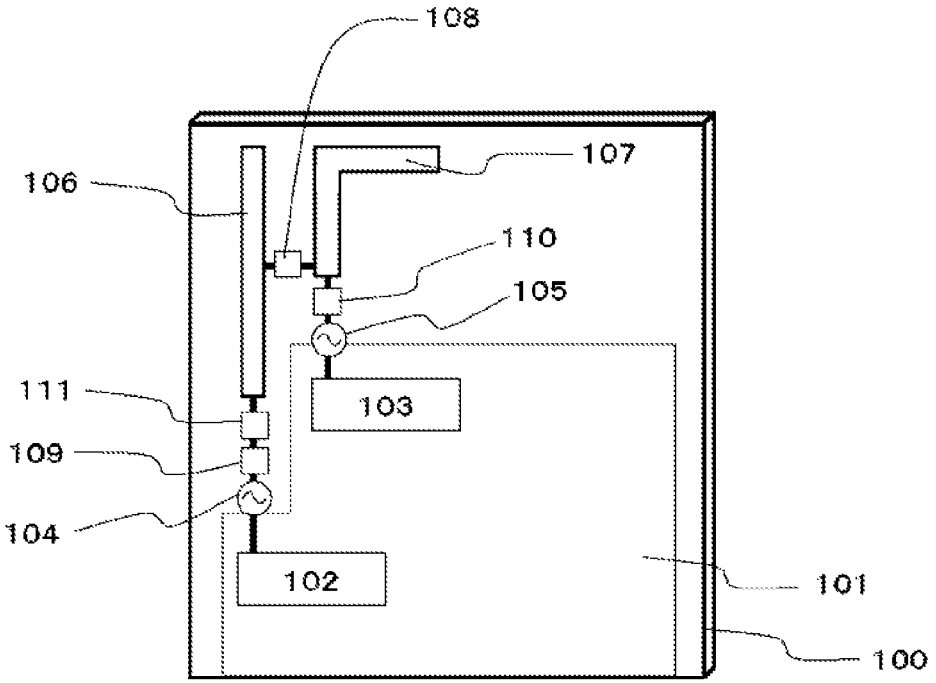
FIG. 9 shows a configuration of a portable wireless terminal according to a second embodiment of the present invention.

FIG. 9 shows a configuration of a portable wireless terminal according to a second embodiment of the present invention. Items in FIG. 9 having the same ones in FIG. 1 are given the same symbols as the latter and will not be described.

As shown in FIG. 9, the first feeding portion 104 and the second feeding portion 105 are disposed so as to be distant from each other in the longitudinal direction of the portable wireless terminal 100, the second antenna element 107 is bent approximately at 90° to the side that is opposite to the first antenna element 106 (i.e., so as to extend in the width direction), and the first connection circuit 108 is disposed at any position that is located between the approximately-parallel-extending portions of the first antenna element 106 and the second antenna element 107.

With the above configuration, the degree of freedom of designing is increased. In the first frequency band, a high degree of isolation is secured by lowering the degree of coupling. In the second frequency band, high-gain performance can be realized by increasing the antenna operation volume by using the cutoff circuit. Plural connection circuits may be used and disposed at positions that are different from the position shown in the figure.

(Embodiment 3)

Figure 10:
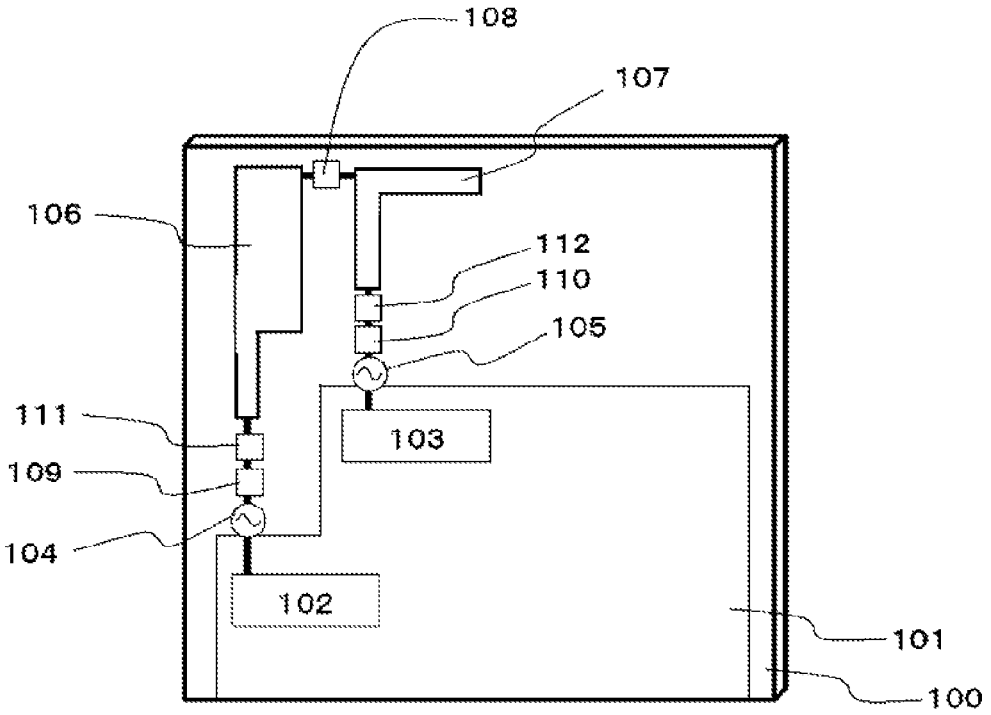
FIG. 10 shows a configuration of a portable wireless terminal according to a third embodiment of the present invention.

FIG. 10 shows a configuration of a portable wireless terminal according to a third embodiment of the present invention. Items in FIG. 10 having the same ones in FIG. 1 are given the same symbols as the latter and will not be described.

In FIG. 10, the operation frequencies of the first antenna element 106 are made the first frequency band and a third frequency band that is higher than the first frequency band. And the operation frequencies of the second antenna element 107 are made the first frequency band and a second frequency band that is lower than the first frequency band. A third frequency band cutoff circuit 112 is disposed between the second antenna element 107 and the second impedance matching circuit 110.

With the above configuration, in the first frequency band, a high degree of isolation is secured by lowering the degree of coupling. In the second frequency band and the third frequency band, high-gain performance can be realized by increasing the antenna operation volume by using the cutoff circuits. Although the first antenna element 106 is wide to increase its bandwidth, its shape is not limited to the illustrated one.

Next, a description will be made of example results of analyses on the performance of specific versions of the configuration of FIG. 10.

In the following description, it is assumed that the first, second, and third frequency bands are assumed to be a 1.5-GHz band, an 800-MHz band, and a 2.4-GHz band, respectively FIG. 11 is a table showing characteristic analysis conditions for the portable wireless terminal according to the third embodiment of the present invention. A 1.5-GHz band connection circuit 108*b* accommodates the 1.5-GHz band, and an 800-MHz band cutoff circuit 111*a* and a 2.4-GHz band cutoff circuit 112*a* are provided. Conditions 1-3 are different from each other in the presence/absence of the 1.5-GHz band connection circuit 108*b*, the 800-MHz band cutoff circuit 111*a*, and the 2.4-GHz band cutoff circuit 112*a*.

Figure 12:
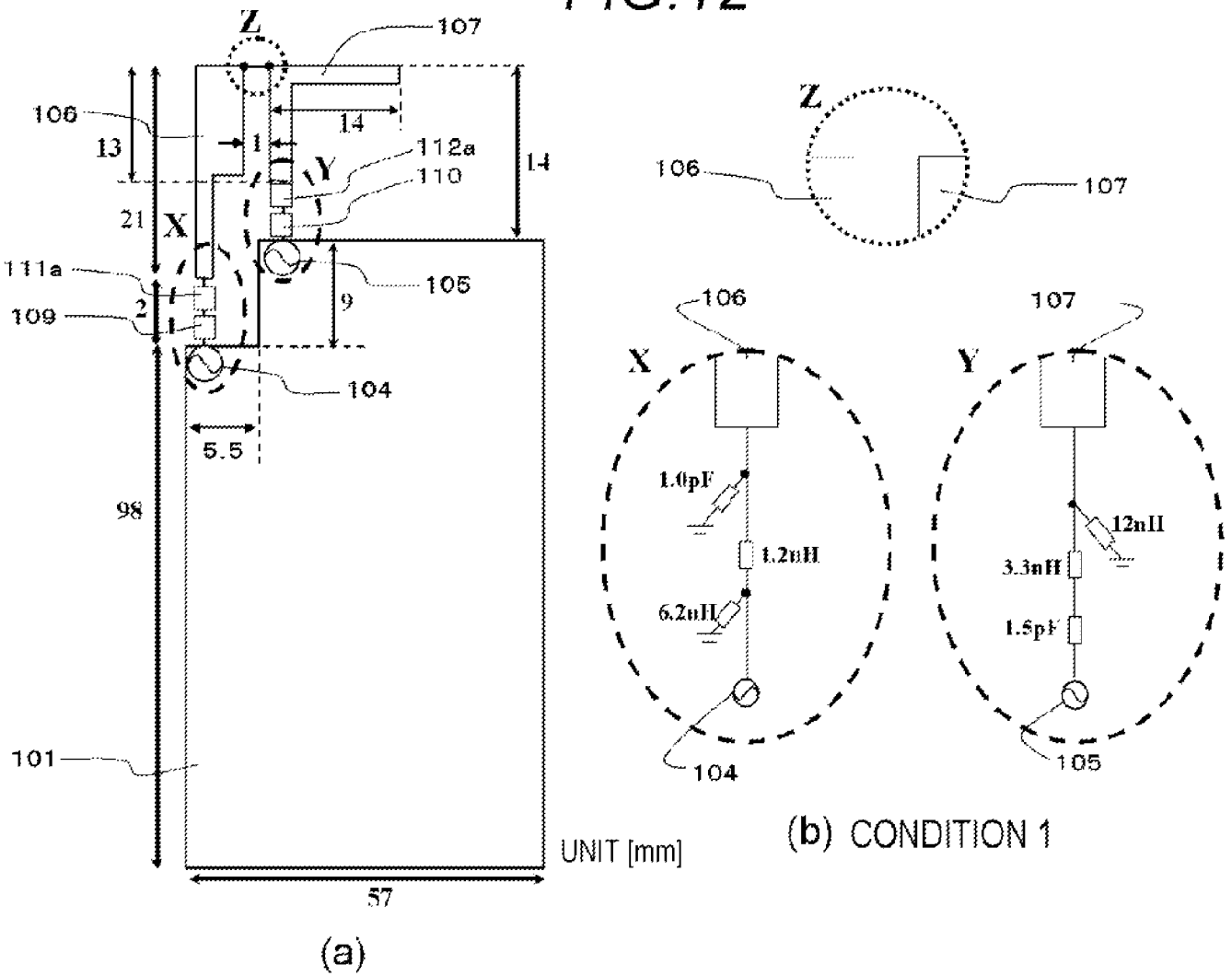
In FIG. 12, (*a*) and (*b*) show a characteristic analysis model of condition 1 for the portable wireless terminal according to the third embodiment of the present invention.

FIGS. 12(*a*) to 13(*b*) show characteristic analysis models for the portable wireless terminal according to the third embodiment of the present invention. As shown in FIG. 12(*a*), an analysis is performed using a model of the circuit board 101 which is a printed circuit board made of a glass epoxy resin, the model being a copper foil of 121 mm in length and 57 mm in width. The circuit board 101 supplies high frequency signals to the first antenna element 106 and the second antenna element 107 which are conductive copper plates via the first feeding portion 104 and the second feeding portion 105, respectively.

The first feeding portion 104 supplies a high-frequency signal in a range of 0.6 GHz to 3 GHz which includes the 1.5-GHz band and the 2.4-GHz band which corresponds to the 2.4-GHz band cutoff circuit 112*a*. The second feeding portion 105 supplies a high-frequency signal in a range of 0.6 GHz to 3 GHz which includes the 1.5-GHz band and the 800-MHz band which corresponds to the 800-MHz band cutoff circuit 111*a*. A pass characteristic S21 and reflection characteristics S11 and S22 which are S parameters and radiation efficiency are analyzed at the above analysis frequencies.

The first antenna element 106 is a conductor plate whose portion from its end on the side of the first feeding portion 104 to the position that is distant from the first feeding portion 104 by 10 mm is 1.4 mm in width and whose portion from the latter position to the position that is distant from the first feeding portion 104 by 21 mm is 4 mm in width. On the other hand, the second antenna element 107 is composed of a conductor plate of 13 mm in length and 2 mm in width which is approximately parallel with the first antenna element 106 and a conductor plate of 14 mm in length and 2 mm in width which is bent from the above conductor plate approximately at 90° to the side that is opposite to the first antenna element 106 so as to extend in the width direction of the first antenna element 106 from the position corresponding to the tip of the first antenna element 106 in its longitudinal direction.

The first antenna element 106 and the second antenna element 107 are disposed adjacent to end portions of the circuit hoard 101. Approximately-parallel-extending portions (closest, portions) of the first antenna element 106 and the second antenna element 107 are very close to each other (the interval is 1 mm which is shorter than 0.01 times the wavelength at 2.4 GHz). Since the first antenna element 106 and the second antenna element 107 are disposed approximately parallel with each other with a very short electrical distance, mutual coupling occurs between the antenna elements and a high-frequency current flowing through one antenna element causes an induction current in the other antenna element. This results in degradation in antenna radiation performance in the first frequency band in which both antenna elements operate.

in view of the above, the 1.5-GHz band connection circuit 108*b* is inserted so as to be connected between end portions of the first antenna element 106 and the second antenna element 107, whereby mutual coupling impedance occurring between the antennas in the 1.5-GHz band is canceled out and the degradation occurring due to the coupling between the antennas in the 1.5-GHz band is thereby reduced.

Since the 800-GHz band cutoff circuit 111*a* is provided between the first antenna element 106 and the first feeding portion 104, the flowing of a high-frequency current in the 800-MHz band into the first feeding portion 104 via the 1.5-GHz band connection circuit 108*b* is suppressed and the degradation due to the coupling between the first feeding portion 104 and the second feeding portion 105 can thereby be reduced. Since not only does a high-frequency current in the 800-MHz band flow through the second antenna element 107 but also a high-frequency current in the 800-MHz band is effectively caused to flow through the first antenna element 106, the antenna operation volume can be increased and the radiation efficiency in the 800-MHz band can thereby he increased.

On the other hand, since the 2.4-GHz band cutoff circuit 112*a* is provided between the second antenna element 107 and the second feeding portion 105, the flowing of a high-frequency current in the 2.4-GHz band into the second feeding portion 105 via the 1.5-GHz band connection circuit 108*b* is suppressed and the degradation occurring due to the coupling between the first feeding portion 104 and the second feeding portion 105 can thereby be reduced. Since not only does a high-frequency current in the 2.4-GHz band flow through the first antenna element 106 but also a high-frequency current in the 2.4-GHz band is effectively caused to flow through the second antenna element 107, the antenna operation volume can be increased and the radiation efficiency in the 2.4-GHz band can thereby be increased.

Furthermore, since the first impedance matching circuit 109 is provided between the first feeding portion 104 and the 800-MHz band cutoff circuit 111*a* and the second impedance matching circuit 110 is provided between the second feeding portion 105 and the 2.4-GHz band cutoff circuit 112*a*, impedance matching with the first antenna element 106, impedance matching with the second antenna element 107, and adjustments for canceling out the mutual coupling impedance between the antenna elements can be made more finely and the effect of reducing the degradation due to coupling is thereby enhanced.

FIG. 12(*b*) shows circuit structures corresponding to condition 1 shown in FIG. 11 which are provided in respective regions X, Y and Z shown in FIG. 12(*a*). According to condition 1 shown in FIG. 11, the 1.5-GHz band connection circuit 108*b* is not provided in the region Z shown in FIG. 12(*b*). On the other hand, in the region X, the first impedance matching circuit 109 is provided in which 1.2 nH is provided in series with the first antenna element 106 from the side of the first feeding portion 104. Furthermore, 6.2 nH is provided between the ground pattern of the circuit board and the connecting point of the first feeding portion 104 and 1.2 nH and 1.0 pF is provided between the ground pattern of the circuit board and the connecting point of the first antenna element 106 and 1.2 nH (6.2 nH and 1.0 pF are each grounded).

In the region Y, the second impedance matching circuit 110 is provided in which 1.5 pF and 3.3 nH are provided in series with the second antenna element 107 in this order from the side of the second feeding portion 105. Furthermore, 12 nH is provided between the ground pattern of the circuit board and the connecting point of the second antenna element 107 and 3.3 nH (12 nH is grounded). The circuit configuration corresponding to condition 1 has been described above.

Figure 13:
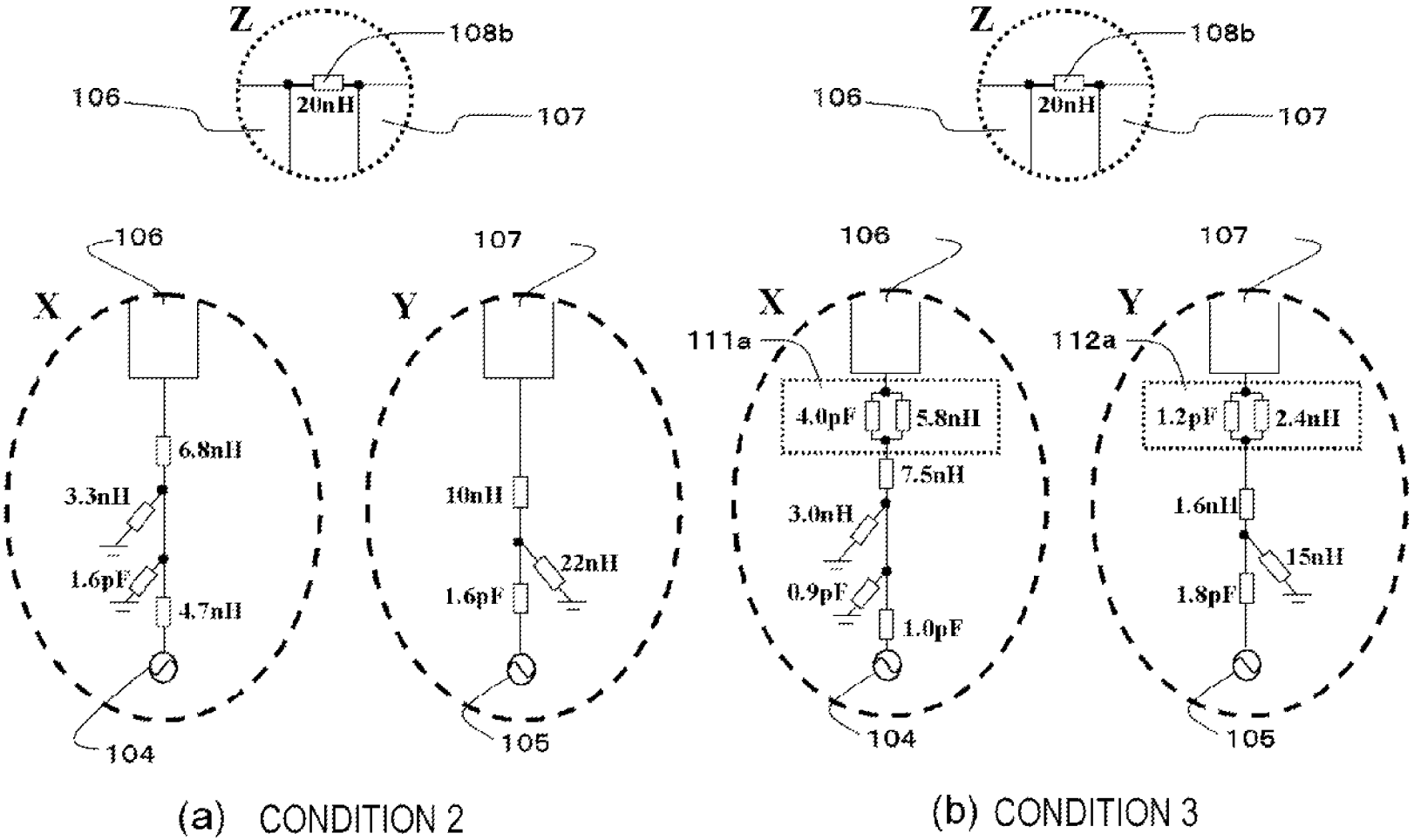
In FIG. 13, (*a*) and (*b*) show characteristic analysis models of conditions and 3 for the portable wireless terminal according to the third embodiment of the present invention.

FIG. 13(*a*) shows circuit structures corresponding to condition 2 shown in FIG. 11 which are provided in the respective regions X, Y, and Z shown in FIG. 12(*a*). According to condition 2 shown in FIG. 11, an inductor of 20 nH is provided as the 1.5-GHz band connection circuit 108*b* in the region Z shown in FIG. 13(*a*). In the region X, the first impedance matching circuit 109 is provided in which 4.7 nH and 6.8 nH are provided in series with the first antenna element 106 in this order from the side of the first feeding portion 104. Furthermore, 1.6 pF and 3.3 nH are provided between the ground pattern of the circuit board and the connecting point of 4.7 nH and 6.8 nH (1.6 pF and 3.3 nH are each grounded).

In the region Y the second impedance matching circuit 110 is provided in which 1.6 pF and 10 nH are provided in series with the second antenna element 107 in this order from the side of the second feeding portion 105. Furthermore, 22 nH is provided between the ground pattern of the circuit board and the connecting point of 1.6 pF and 10 nH (22 nH is grounded). The circuit configuration corresponding to condition 2 has been described above.

FIG. 13(*b*) shows circuit structures corresponding to condition 3 shown in FIG. 11 which are provided in the respective regions X, Y and Z shown in FIG. 12(*a*). According to condition 3 shown in FIG. 11, an inductor of 20 nH is provided as the 1.5-GHz band connection circuit 108*b* in the region Z shown in FIG. 13(*b*). The first impedance matching circuit 109 and the 800-MHz band cutoff circuit 111*a* are provided in the region X. Elements 1.0 pF and 7.5 nH are provided in series with the first antenna element 106 in this order from the side of the first feeding portion 104. Furthermore, a parallel resonance circuit which is composed of 4.0 pF and 5.8 nH and corresponds to the 800-MHz band cutoff circuit 111*a* is provided between 7.5 nH and the first antenna element 106.

Still further, 0.9 pF and 3.0 nH are provided between the ground pattern of the circuit board and the connecting point of 1.0 pF and 7.5 nH (0.9 pF and 3.0 nH are each grounded). The second impedance matching circuit 110 and the 2.4-GHz band cutoff circuit 112*a* are provided in the region Y. Elements 1.8 pF and 1.6 nH are provided in series with the second antenna element 107 in this order from the side of the second feeding portion 105. Furthermore, a parallel resonance circuit which is composed of 1.2 pF and 2.4 nH and corresponds to the 2.4-GHz band cutoff circuit 112*a* is provided between 1.6 nH and the second antenna element 107.

Furthermore, 15 nH is provided between the ground pattern of the circuit-board and the connecting point of 1.8 pF and 1.6 nH (15 nH is grounded). The circuit configuration corresponding to condition 3 has been described above.

Figure 14:
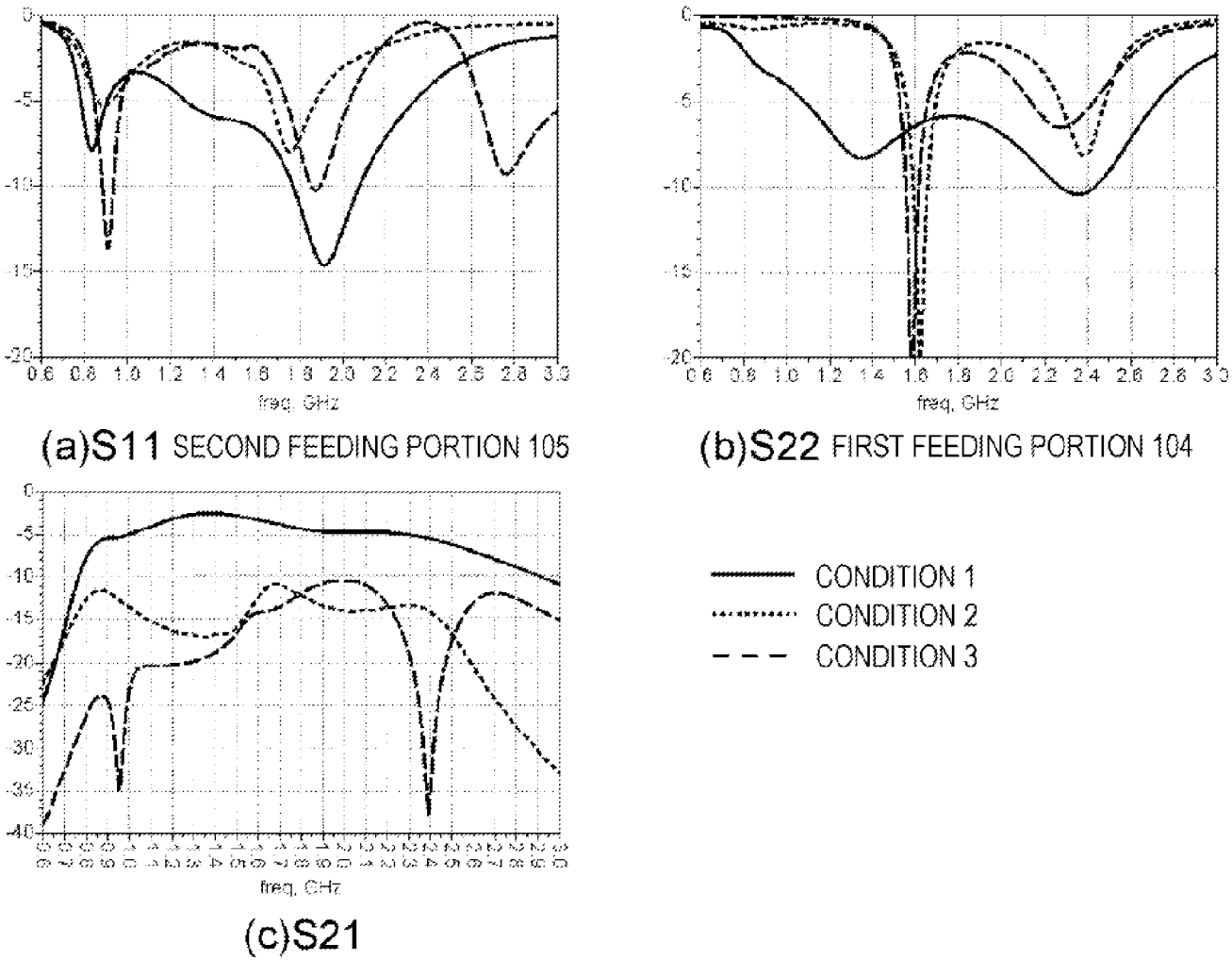
In FIG. 14, (*a*) to (*c*) are characteristic graphs showing frequency characteristics of the portable wireless terminal according to the third embodiment of the present invention which were obtained under analysis conditions 1 to 3.
Figure 15:
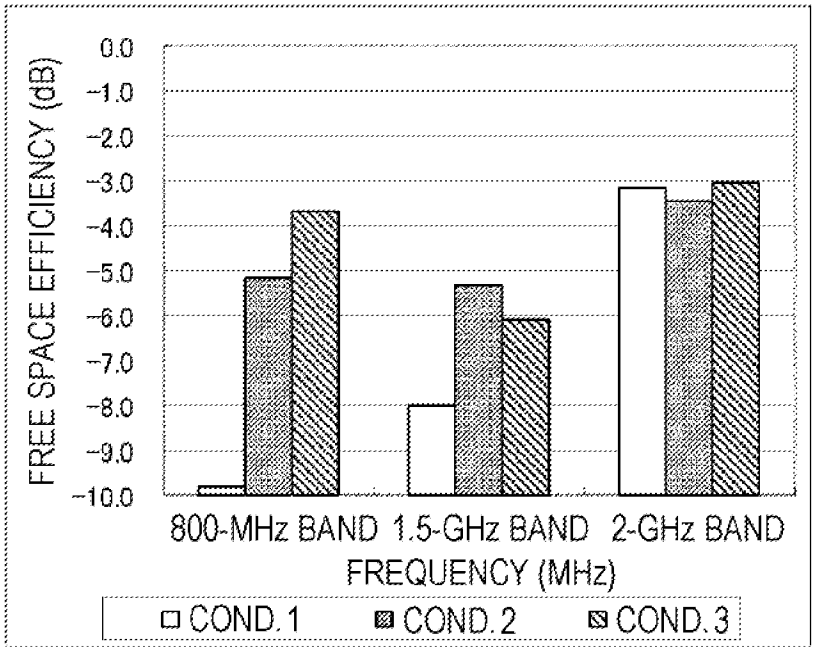
In FIG. 15, (*a*) and (*b*) are characteristic graphs showing free space efficiency of the portable wireless terminal according to the third embodiment of the present invention which were obtained under the analysis conditions 1 to 3.
Figure 15:
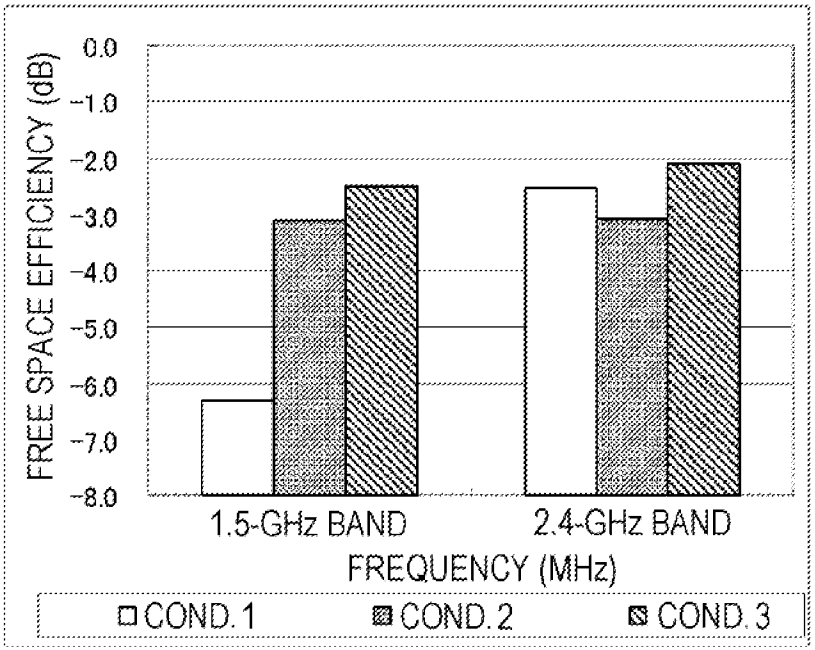

FIGS. 14(*a*) to 15(*b*) are characteristic graphs of the third embodiment of the present invention which were obtained by analyses using the analysis models shown in FIGS. 12(*a*) to 13(*b*). FIG. 14(*a*) shows S11 curves as viewed from the second feeding portion 105, FIG. 14(*b*) shows S22 curves as viewed from the first feeding portion 104, and FIG. 14(*c*) shows S21 curves which are pass characteristics from the second feeding portion 105 to the first feeding portion 104. In each of FIGS. 14(*a*)-14(*c*), the horizontal axis represents the frequency from 0.6 GHz to 3 GHz. FIG. 15(*a*) shows free space efficiency characteristics of the second antenna element 107, and FIG. 15(*b*) shows free space efficiency characteristics of the first antenna element 106.

As seen from FIG. 14(*a*), under conditions 1-3, S11 is small (approximately smaller than −5 dB) in the 800-GHz band and a range of 1.7 GHz to 1.9 GHz, which means that impedance matching is made properly in these frequency ranges. On the other hand, as seen from FIG. 14(*b*), under conditions 1-3, S22 is small (approximately smaller than −5 dB) in the 1.5-GHz band and the 2.4-GHz band, which means that impedance matching is made properly in these frequency ranges.

As shown in FIG. 14(*c*), under all the conditions except condition 1, the pass characteristic S21 is small (smaller than −10 dB) over the almost entire frequency range, which means a high degree of isolation is secured and the degradation due to coupling is reduced. As seen from FIG. 15(*a*), as for the free space efficiency of the second antenna element 107, under conditions 2 and 3, the antenna efficiency is the same as or higher than under condition 1.

It is seen that in the 1.5-GHz band the degradation due to coupling is reduced to a large extent because S21 is about −10 dB. It is also seen that under condition 3 (the 800-MHz band cutoff circuit 111*a* is provided) the free space efficiency is increased in the 800-MHz band.

Likewise, as seen from FIG. 15(*b*), as for the free space efficiency of the first antenna element 106, the antenna efficiency is higher under conditions 2 and 3 than under condition 1. It is seen that in the 1.5-GHz band the degradation due to coupling is reduced to a large extent because S21 is about −10 dB.

It is also seen that under condition 3 (the 2.4-GHz band cutoff circuit 112*a* is provided) the free space efficiency is increased in the 2.4-GHz band. Furthermore, it is seen that under condition 3 (both of the 800-MHz band cutoff circuit 111*a* and the 2.4-GHz band cutoff circuit 112*a* are provided) the free space efficiency is increased in both frequency bands.

As described above, with the first antenna element 106 which operates in the first frequency band and the third frequency band and the second antenna element 107 which operates in the first frequency band and the second frequency band, the third embodiment makes it possible to form built-in antennas in which in the first frequency band a high degree of isolation is secured by lowering the degree of coupling and in the second and third frequency bands high-gain performance can be realized by increasing the antenna operation volume by using the cutoff circuits.

Figure 16:
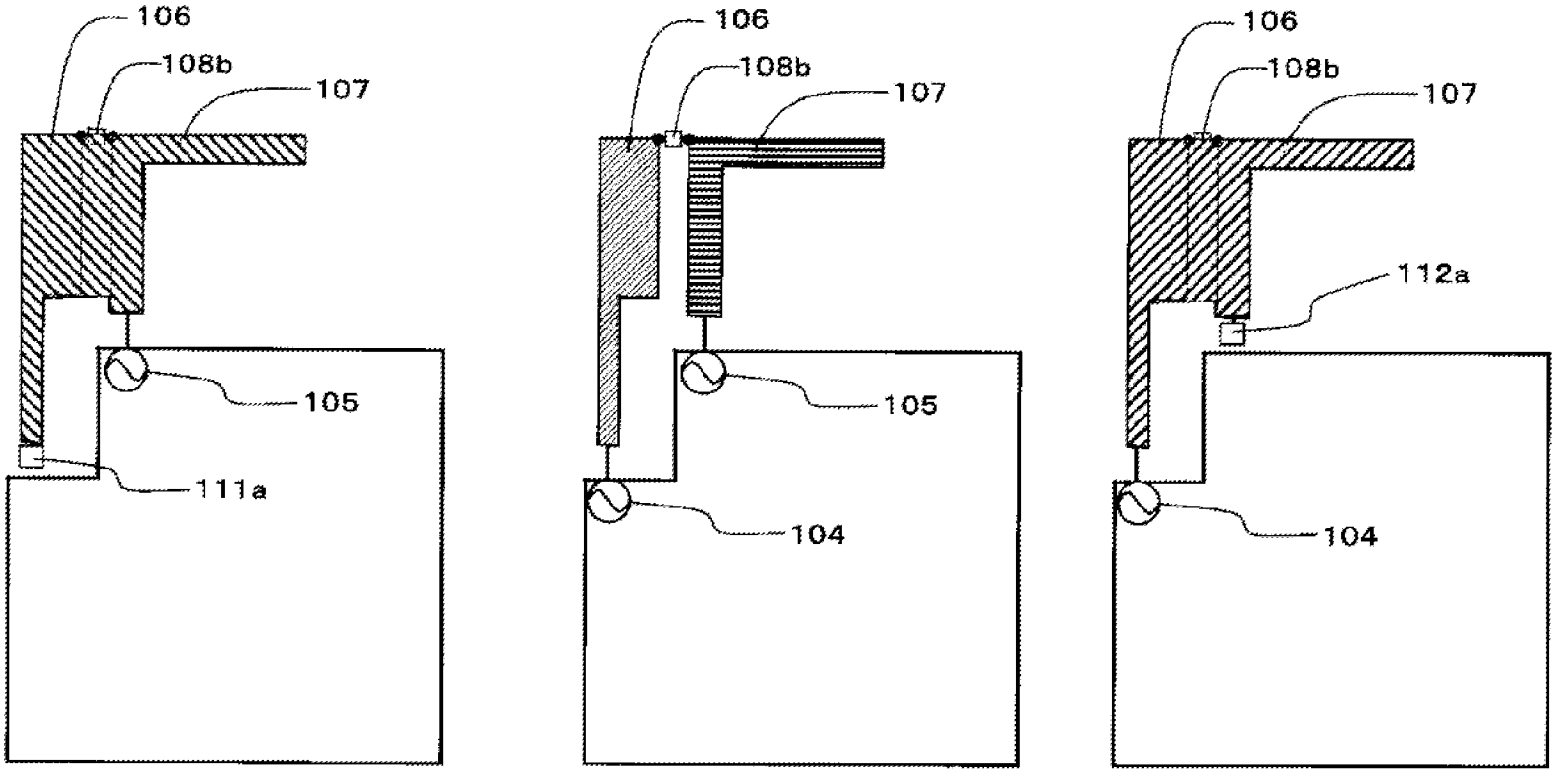
In FIG. 16, (*a*) to (*e*) outline how the portable wireless terminal according to the third embodiment of the present invention operates in respective frequency bands.

In FIG. 16, (*a*) to (*c*) outline how the portable wireless terminal according to the third embodiment of the present invention operates in the respective frequency bands. FIG. 16(*a*) outlines how the portable wireless terminal operates in the 800-MHz band which is the second frequency band. A high-frequency current in the 800-MHz band is supplied from the second feeding portion 105 not only to the second antenna element 107 but also to the first antenna element 106 (via, the 1.5-GHz band connection circuit 108*b*).

At the same time, since the 800-MHz band cutoff circuit 111*a* exists, a current flowing into the first feeding portion 104 can be suppressed. Therefore, in the 800-MHz band, the performance can be improved by increasing the antenna operation volume while a high degree of isolation is secured between the first feeding portion 104 and the second feeding portion 105.

FIG. 16(*b*) outlines how the portable wireless terminal operates in the 1.5-GHz band which is the first frequency band. As for a high-frequency current in the 1.5-GHz band that is supplied to the first antenna element 106 from the first feeding portion 104 and a high-frequency current in the 1.5-GHz band that is supplied to the second antenna element. 107 from the second feeding portion 105, the mutual coupling impedance is adjusted by the 1.5-GHz band connection circuit 108*b* which is provided between the first antenna element 106 and the second antenna element 107, whereby opposite-phase currents occurring between the first antenna element 106 and the second antenna element 107 are reduced and the degradation due to coupling can thereby be reduced.

FIG. 16(*c*) outlines how the portable wireless terminal operates in the 2.4-GHz band which is the third frequency band. A high-frequency current in the 2.4-GHz band is supplied from the first feeding portion 104 not only to the first antenna element 106 but also to the second antenna element 107 (via the 1.5-GHz band connection circuit 108*b*). At the same time, since the 2.4-GHz band cutoff circuit 112*a* exists, a current flowing into the second feeding portion 105 can be suppressed. Therefore, in the 2.4-GHz band, the performance can be improved by increasing the antenna operation volume while a high degree of isolation is secured between the first feeding portion and the second feeding portion 105.

(Embodiment 4)

Figure 17:
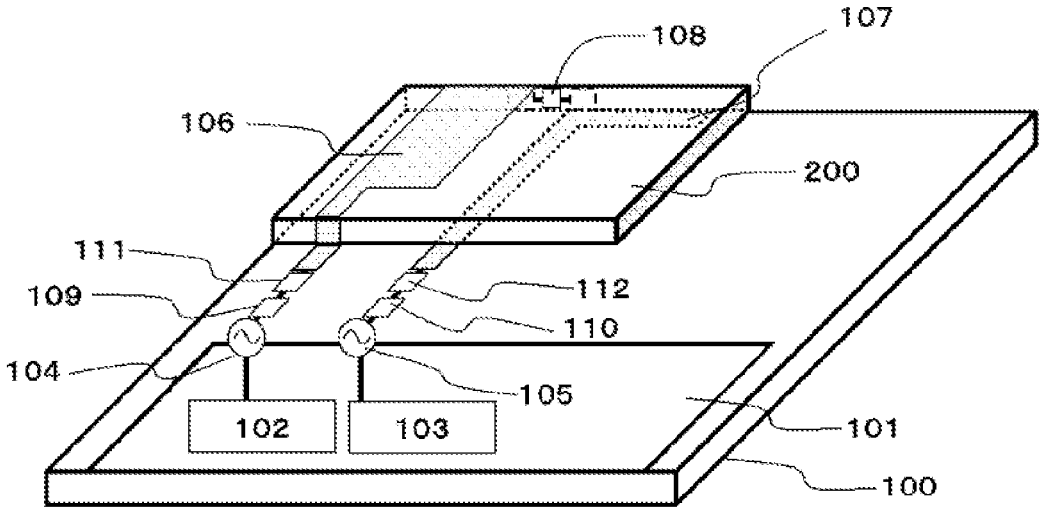
FIG. 17 shows a configuration of a portable wireless terminal according to a fourth embodiment of the present invention.

FIG. 17 shows a configuration of a portable wireless terminal according to a fourth embodiment of the present invention. Items in FIG. 17 having the same ones in FIG. 10 are given the same symbols as the latter and will not be described.

As shown in FIG. 17, parts of the first antenna element 106 which operates in the first frequency band and the third frequency band which is higher than the first frequency band and the second antenna element 107 which operates in the first frequency band and the second frequency band which is lower than the first frequency band are formed on a printed circuit board 200. Tip portions of the first antenna element 106 and the second antenna element 107 are formed on a side surface (located on the side of one end of the portable wireless terminal 100 in its longitudinal direction) of the printed circuit board 200. The first connection circuit 108 is disposed between the first antenna element 106 and the second antenna element 107.

With this configuration, the degree of freedom of designing is increased. In the first frequency band, a high degree of isolation is secured by lowering the degree of coupling. In the second and third frequency bands, high-gain performance can be realized by increasing the antenna operation volume by using the cutoff circuits.

(Embodiment 5)

Figure 18:
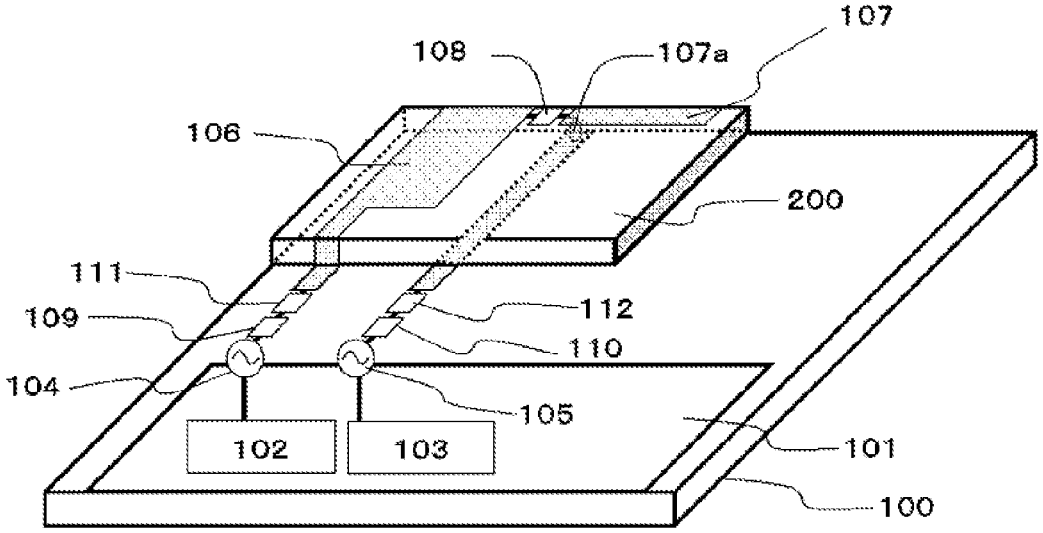
FIG. 18 shows a configuration of a portable wireless terminal according to a fifth embodiment of the present invention.

FIG. 18 shows a configuration of a portable wireless terminal according to a fifth embodiment of the present invention. Items in FIG. 18 having the same ones i FIG. 10 are given the same symbols as the latter and will not be described.

As shown in FIG. 18, the second antenna element 107 which operates in the first frequency band and the second frequency band which is lower than the first frequency band is formed on different surfaces of a printed circuit board 200 using a through-hole via 107*a*. With this configuration, the first connection circuit 108 can be disposed on a surface of the printed circuit board 200 and the degree of freedom of designing is thereby increased. Furthermore, in the first frequency band, a high degree of isolation is secured by lowering the degree of coupling. In the second and third frequency bands, high-gain performance can be realized by increasing the antenna operation volume by using the cutoff circuits.

Although the present invention has been described in detail by referring to the particular embodiments, it is apparent to a person skilled in the art that various changes and modifications are possible without departing from the spirit and scope of the present invention.

The present application is based on the Japanese Patent Application No. 2011-093744 filed on Apr. 20, 2011, the contents of which are incorporated herein by reference.

INDUSTRIAL APPLICABILITY

The antenna device and the portable wireless terminal using it according to the present invention are useful when used in or as a portable wireless terminal such as a cell phone, because the performance can be improved by increasing the antenna operation volume while a high-degree of isolation is secured in a wide band by lowering the degree of coupling in the case of operation in the same frequency band and using a cutoff circuit(s) in the case of operation in different frequency hands.

REFERENCE SIGNS LIST

100: Portable wireless terminal
101: Circuit board
102: First radio circuit unit
103: Second radio circuit unit
104: First feeding portion
105: Second feeding portion
106: First antenna element
107: Second antenna. element
107*a*: Through-hole via
108: First connection circuit
108*a*, 108*b*: 15-GHz band connection circuit
109: First impedance matching circuit
110: Second impedance matching circuit
111: Second frequency band cutoff circuit
111*a*: 800-MHz band cutoff circuit
111*b*, 112*a*: 2.4-GHz band cutoff circuit
112: Third frequency band cutoff circuit
200: Printed circuit board

The invention claimed is:

1. An antenna device comprising:
an enclosure;
a circuit board provided in the enclosure and having a ground pattern;
a first antenna element which is made of a conductive metal and operates in a first frequency band;
a second antenna element which is made of a conductive metal and operates in the first frequency band and a second frequency band;
a first connection circuit which electrically connects portions of the first antenna element and the second antenna element;
a first radio circuit unit provided on the circuit board;
a first feeding portion electrically connected to the first radio circuit unit;
a second radio circuit unit provided on the circuit board;
a second feeding portion electrically connected to the second radio circuit unit; and
a second frequency band cutoff circuit for electrical cutoff in the second frequency band, an electrical pathway between the second frequency band cutoff circuit and the first feeding portion being shorter than an electrical pathway between the first connection circuit and the first feeding portion, wherein
the first antenna element and the second antenna element are disposed close to each other so as have a predetermined interval from the ground pattern on the circuit board,
the first antenna element is electrically connected to the first feeding portion via the second frequency band cutoff circuit,
the second antenna element is electrically connected to the second feeding portion, and
the first connection circuit is configured to cancel out mutual coupling impedance between the first antenna element and the second antenna element in the first frequency band.

2. The antenna device according to claim 1, wherein
the first antenna element is electrically connected to the first feeding portion via a first impedance matching circuit, or
the second antenna element is electrically connected to the second feeding portion via a second impedance matching circuit.

3. The antenna device according to claim 1, wherein
one or both of the first antenna element and the second antenna element are partly at least formed of a copper foil pattern formed on the printed circuit board.

4. The antenna device according to claim 1, wherein the first antenna element operates in the first frequency band and a third frequency band which is higher than the first frequency band, the second antenna element operates in the first frequency band and the second frequency band which is lower than the first frequency band, and a third frequency band cutoff circuit for electrical cutoff in the third frequency band is electrically connected between the second antenna element and the second feeding portion.

5. A portable wireless terminal equipped with the antenna device according to claim 1.

6. The antenna device according to claim 1, wherein the first antenna element has an electrical length as to operate in the first frequency band, and the second antenna element has an electrical length as to operate both in the first frequency band and in the second frequency band.

7. The antenna device according to claim 6, wherein the first antenna element has a length that is equal to ¼ of a wavelength of a center frequency of the first frequency band, and the second antenna element has a length that is equal to ¼ of a wavelength of a center frequency between the first frequency band and the second frequency band.

8. The antenna device according to claim 1, wherein a high-frequency current in the second frequency band supplied from the second feeding portion is cutoff by the second frequency band cutoff circuit and flows into the first feeding portion.

9. The antenna device according to claim 1, wherein the first and second frequency bands are a 1.5-GHz band and an 800-MHz band, respectively.

* * * * *